US006219886B1

(12) United States Patent
Wagner et al.

(10) Patent No.: US 6,219,886 B1
(45) Date of Patent: Apr. 24, 2001

(54) PROCESS AND APPARATUS FOR STRETCHING FIBER BAND AND STORAGE OF SAME

(75) Inventors: Manfred Wagner, Ingolstadt; Armin Brunner, Elsendorf, both of (DE); Beat Näf, Jona; Lars Weisigk, Winterthur, both of (CH)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/363,133

(22) Filed: Jul. 28, 1999

(30) Foreign Application Priority Data

Aug. 12, 1998 (DE) ..... 198 36 482

(51) Int. Cl.[7] ..... D04H 11/00

(52) U.S. Cl. ..... 19/159 A; 19/159 R; 198/345.1; 198/345.3

(58) Field of Search ..... 19/150, 157, 159 A, 19/159 R; 57/90, 281; 198/345.1, 345.3

(56) References Cited

U.S. PATENT DOCUMENTS

| | | | | |
|---|---|---|---|---|
| 3,323,177 | * | 6/1967 | Binder et al. | 19/159 A |
| 3,354,513 | * | 11/1967 | Fornes | 19/159 A |
| 3,976,203 | | 8/1976 | Hegner . | |
| 4,561,151 | | 12/1985 | Schöpwinkel . | |
| 5,339,615 | * | 8/1994 | Hauner | 57/281 |
| 5,682,647 | * | 11/1997 | Leifeld | 19/159 A |
| 5,815,888 | * | 10/1998 | Temburg | 19/159 A |

FOREIGN PATENT DOCUMENTS

| | | |
|---|---|---|
| 2354634 | 5/1974 | (DE) . |
| 3713265A1 | 11/1988 | (DE) . |
| 3734265A1 | 4/1989 | (DE) . |
| 195 45 682 | 6/1997 | (DE) . |
| 1386573 | 3/1975 | (GB) . |
| 2315279 | 1/1998 | (GB) . |

OTHER PUBLICATIONS

German Patent Office Search Report, Dec. 17, 1998.

* cited by examiner

*Primary Examiner*—John J. Calvert
*Assistant Examiner*—Gary L. Welch
(74) *Attorney, Agent, or Firm*—Dority & Manning

(57) ABSTRACT

A stretched fiber band is deposited in a can, located in the filling station of a can exchanger of a draw frame, by means of a turntable. The rotational axis of the turntable exhibits an equal to or less than distance from the rotational axis of the can exchanger than the distance from the center point of the can found in the filling station to the rotational axis of the exchanger. Upon the substitution of the filled can by an empty can held in a ready-state position, the operation of the can exchanger on the rotation of the turntable is designed in such a manner, that the fiber band is deposited into the full can exiting the filling station, until this can leaves the zone of the turntable. The fiber band is then deposited into the empty can which has been brought into the filling station II, as soon as this empty can reaches the zone of the turntable. To enable this procedure, the empty can to be delivered to the filling station is temporarily moved with increased speed, and the spatial interval between the empty can to be delivered to the filling station and the full can which is leaving the filling station is reduced.

23 Claims, 3 Drawing Sheets

PROCESS AND APPARATUS FOR STRETCHING FIBER BAND AND STORAGE OF SAME

BACKGROUND

The present invention concerns a process, as well as an apparatus, for drawing at least one continuously fed fiber band, and for storing the drawn fiber band in a can.

Customarily, for the carrying out of a can exchange, a draw frame is brought to a standstill and the can exchange is made (for example, Rieter Draw Frame RSB-D30). Only after the exchange has been completed, is the operation of the draw frame resumed. In this way, the cans, as a rule, on the feed side and the removal side, are exchanged.

A method is already known to carry out the can exchange "on the fly", that is, without interruption of the operative process (DE OS 2 354 634). In this case, the fiber band, which issues from the machine during the time necessary for the can exchange, is received in a reception container, which is then emptied into the new empty can after the can exchange has been completed. The quantity of fiber band so received in the container during this interval, is relatively large, so that, with this in consideration, a relatively large quantity of fiber band falls in disorder into the empty can. This can lead to disturbances in the later course of the operation during continued work-up of the fiber band. Further, because of the linear design of the can exchanger, a great deal of space is required.

OBJECTS AND SUMMARY OF THE INVENTION

Thus a primary purpose of the present invention is to create a process and an apparatus, with which these disadvantages will be avoided. In doing this, the possibility will be brought about that first, the draw frame does not interrupt its operation during the can exchange, and second, no great length of fiber band must be accumulated to be placed in disorder in the new can to be filled. Furthermore, the apparatus is to be simple and compact in its design. Additional objects and advantages of the invention will be set forth in part in the following description, or may be obvious from the description, or may be learned through practice of the invention.

The purposes will be achieved, in keeping with the invention, by a process for the drawing of at least one continuously fed, fiber band and for the storage of the drawn fiber band in a can, by which process a rotatable can exchanger turning about an axis, brings to be filled, an available, empty can held in a ready-state waiting position into a filling station underneath a turntable, whereupon, after the filling, the can is moved to a reject position, therein characterized, in that the can to be filled, which is found in the filling station is brought to the fiber band on its side proximal to the rotating axle of the can exchanger. Employing a can exchanger rotatable about an axis, the inventive selection of arranging the fiber band feeding station reaches a point wherein a very short fiber band length issues during the can exchange. This is done with non-interrupted drawing of the at least one fiber band and with an equally maintained tension at unchanged operational speed. This is principally due to the fact that after a cutoff of fiber band entering the filled can, without difficulty, a very short length of still issuing fiber band is transferred to the incoming empty can, so that no disordered fiber band is deposited into incoming empty can.

This process can be optimized by many features. The intermittently driven can exchanger is so adjusted to the rotation of the turntable, that the fiber band is deposited in the filled can left in the filling station as long as the can remains in the area of the turntable and then deposits the fiber band in a subsequent empty can as soon as that can reaches the area of the turntable. Also, the can to be brought to the filling station is moved in accord with a gradual acceleration, essentially from the time, at which the full can leaves the area of the turntable, until the time at which the can to be filled reaches the turntable at a then high velocity. During the can exchange, the spatial interval between the empty can to be brought to the filling station and the full can exiting the filling station is reduced. The empty can, in contrast to the specified path through the can exchange, is brought from the ready-state waiting position by a shortened path into the filling station. The empty can at least in a portion of its path between the ready-state position and the filling sation, is moved along a linear transport path. These features allow the band length to be very short that issues during the can exchange and that is not directly conducted into either the full can, which is leaving the filling station, nor into the can to be filled, which is now entering the filling station. In the meantime, the draw frame continues operation.

For carrying out the invented process, an apparatus is provided for drawing at least one continuously fed fiber band and for the laying of the drawn fiber band in a round can, with a turntable for the equal distribution of the drawn fiber band in a can, with a can exchanger turnable around a rotating axle, controlled by a control apparatus, with the aid of which one available empty can in a ready-state position is brought into a filling station for filling underneath the turntable. After the filling, the can is moved to a reject position, for the execution of the process of the can exchange. The spatial interval axis of rotation of the turntable, from the axis of rotation of the can exchanger is at a maximum just so large as the spatial interval of the center point of the can which is found in the area of the turntable from the axis of rotation of the can. Because of the propinquity of the axis of the turntable to the rotation axle of the can exchanger, the spatial separating interval of the following sequentially arrayed cans is very small. Because of this, as the draw frame continues operation during the can shifting of the exchanger, only a small quantity of fiber band will be fed out through the turntable, the short length of which will give rise to no disturbances in later working-up procedures.

Particularly advantageous, is an arrangement of the turntable in regard to the can which is found in the filling station in which the turn table, in relation to the can that is in the filling station position, is located in the leading portion of the can to be filled. By this means, time for the acceleration of the can exchanger will be gained until the filled can leaves the area of the turntable, so that the can exchanger, in spite of gradual acceleration, has already reached its full speed of rotation when the can carried by it reaches the area beneath the turntable. In this manner, the transition period of the delivery of fiber band between the filled can to the empty can will be a very short interval.

A further reduction of the time span for the transition period of the fiber band from the area above the full can to the empty can newly brought in, is attained by a further, advantageous design of the object. The spatial interval of a can in a ready-state position and/or a can in a reject position to the axis of rotation of the can exchanger is greater than the spatial interval of the can in the filling station from that axis of rotation. Also, the can guide between the ready-state position and the filling station can exhibit a linear section.

The fiber band should be deposited as long as possible in the can positioned in the filling station. Achieving this allows a further advantageous embodiment of the invention in which the turntable and the can exchanger are driven in a common rotary direction.

Advantageously, the relationships for the placements and controls of the drive, were selected so that the drive of the turntable and the can exchanger mutually co-act in such a way, as to the arrangement of the turntable and the cans which are found in the can exchanger, that the band feed opening of the turntable essentially follows the rejection movement of the filled can from the filling station position, until this can leaves the area of the turntable. The band feed opening, then, turns itself back to the empty can now nearing the filling station, and reaches this point essentially when the empty can itself reaches the area of the turntable. This relationship allows the transition of the fiber band depositing between the full can over to the newly placed empty can to be particularly well carried out.

In order to achieve the optimum positions of the full can leaving the filling station and/or the empty can just reaching the filling station, it is advantageous for the control of the can exchange, in consideration of the turntable's start and acceleration, to design the turntable so that a contacting device is specifically provided for the turntable, which device is connected with the control apparatus that controls the can exchanger.

In the case of a conventional draw frame, the turntable is placed as far as possible on that side of the draw frame proximal to the band input. In this way, the cover for the drive of the turntable is only a small distance above the main framing of the draw frame, so that an operator has easy access to this drive. In the arrangement in accord with the present invention, the drive for the turntable is placed farther from the main framing of the draw frame and is set further into the can exchanger. In order, first, to gain access to the drive simply and easily and, second, not to have to accept a compromise in regard to the can exchanger, it is better to provide a platform which extends along the draw frame. The platform possesses a movable partial platform that in its operating position, extends into the can exchanger in that area, which can be invaded neither by a can nor by an element of the can exchanger, and that, in the idle position of the movable partial platform, releases can exchanger. The platform has a monitoring apparatus which is in communication with the control apparatus that is particularly assigned to the movable partial platform. The control apparatus controlling the can exchanger is connected to an alarm, which, as a specified set point before a can exchange is to be executed, releases its alarm. The control apparatus (6) possesses a time adjustment device (67). These improvement to the platform will assure that the operational area of the can exchanger can be freely accessible for maintenance at an opportune time.

Principally, the manner in which the fiber band feed to the draw frame is carried out is of little importance, so long as, if desired, the fiber band from the draw frame is deposited in cans.

It is particularly of advantage, however, if a place where can accumulation takes place on the feed side of the draw frame is removed. In that case, the presentation of one or more fiber bands is accomplished directly from the band issuing machine. In doing this, the number of the incoming fiber bands will depend on the thickness of the incoming band(s) as will the tension depend on the ratio of the band thickness on the incoming side and the band thickness on the outgoing side. This method permits dispensing with the customary intake rolls on the draw frame. Instead of these rolls, an intake funnel, guides the fiber band(s) to be drawn into the draw frame machine.

As a rule, the fiber band conducted to the draw frame is pulled directly through the draw frame, without there being any disturbance from differences between the fiber band feed and the delivery of the drawn band. However, in order to anticipate an occurrence of a short failure in the draw frame or in the can exchanger a band storage means can be inserted before the draw frame.

The previously used term "turntable" should not be interpreted in the present invention just in a narrow sense, but should encompass all other elements, which, during its storage operation, impart to the fiber band a motion for the formation of loops. For instance, instead of a turntable in the narrow sense, even a bent tube could find use, which was set in rotation and the outlet opening thereof provides to the fiber band a motion during the storage operation that corresponds to one of the later described band outlet openings of a turntable.

The process as well as the apparatus in keeping with the present invention provide, in a simple way, the possibility of carrying through a "flying can exchange" on the draw frame without thereby causing great lengths of band entering the can in disorder that must be dealt with later. This goal can be reached with the help of a simple, compactly built apparatus.

Embodiments of the invention are described in greater detail below with the assistance of reference to drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

First will be described and explained, with the help of FIG. 3, an interconnection with a textile machine 1 which delivers feed fiber band, for instance a carding machine, and a draw frame 2 in accord with the invention.

It is known, that a carding machine of conventional construction possesses a drum of large diameter and, on this account, is also of considerable weight. For this reason, such a textile machine 1 is not to be brought to a standstill and then started up again. In order to join the operation of a draw frame 2, to a preceding carding machine 1, it is customary to deposit the delivered fiber band 4 from the carding machine 1 into cans, and to bring the cans to the draw frame 2. Besides the cans, this kind of a process method requires can transport as well as means of can transport. All of these elements increase the length of time of the process and the expensive due to space and material.

Figure 3:
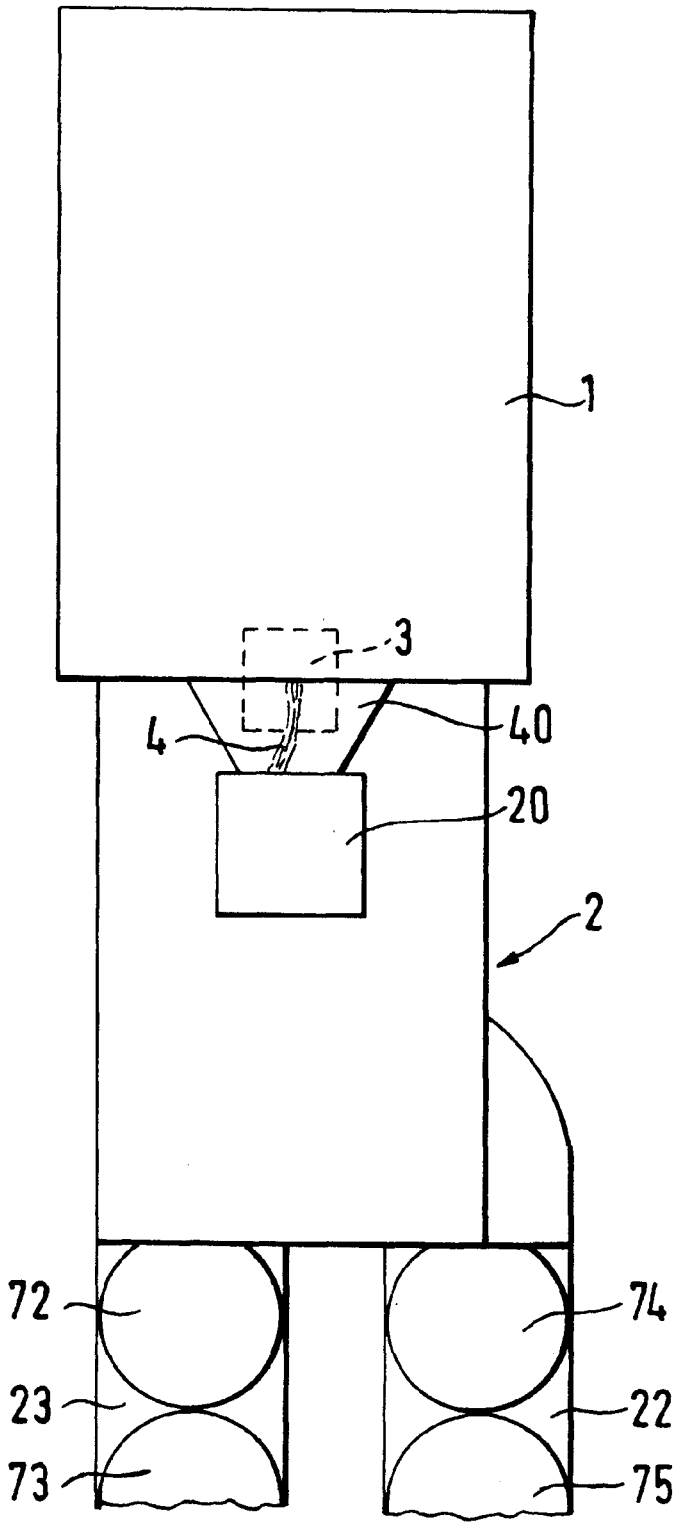
FIG. 3 shows a schematic drawing of a band issuing textile machine in feeding connection with the stretch machine.

Contrary to the described known method, in accord with FIG. 3, the feed side of the draw frame 2 connects directly to the exit of the band dispensing textile machine 1, i.e., the before mentioned carding machine. If necessary, a stationary fiber band storage facility 3 can be provided between the band dispensing textile machine 1 and the draw frame 2. The stationary band storage facility 3 is so designed, that no additional elements for transport need be installed , but, as an example, the storage 3 is suitable for the reception of larger band loops, as this is disclosed in WO 92/05301.

A textile machine 1, in the form of a carding machine, delivers a fiber band 4, the diameter of which is a multiple of the thickness of the band, which normally is delivered from the draw frame 2 to a band reworking textile machine (not shown), which could be an open end spinning machine. If the delivered fiber band 4 from the carding machine 1 has a thickness four-fold that of a conventionally delivered fiber band from a draw frame 2 (not shown), then the fiber band 4 which has been sent to the draw frame will be four-fold drawn.

Since the fiber band 4 need not be drawn out of supply cans, but the band 4 is much more positively delivered from the carding machine 1, the usually necessary intake roll-pair of the draw frame 2 can be dispensed with. In this case, an intake funnel 40 suffices, which guides the feed fiber band 4 into the schematically shown draft zone 20 of the draw frame 2.

On its exit end, the draw frame 2 possesses a can exchanger 5 (FIG. 1) for round cans, which stand in controlled connection with a control apparatus 6.

The can exchanger 5 exhibits an axle 50 (axis of rotation $A_2$), as well as three horizontal arms 51*a*, 51*b*, and 51*c*, which are rotatable by the axle 50. For this purpose, a drive is connected to the axle 50. This drive communicates with the control 6 through line 60.

Each arm 51*a*, 51*b*, and 51*c* is rigidly integral with a horizontal cross bar lever 510 with a vertical bolt 511 respectively on each of its ends, which bolts rotatingly secure rollers 512 and 513, respectively. The cross bar levers 510 are placed, as seen in the top view, at an angle to the arms 51*a*, 51*b*, and 51*c* in such a way, that, in reference to the direction of rotation (arrow $f_1$) of the can exchanger 50, the forward roller 512 shows a greater distance from the axle 50 than does the trailing roller 513.

The can exchanger 5 has the purpose of bringing an empty can 70 out of a ready state position I to occupy a filling station II and find itself underneath a turntable 8 now as can 7. The previous can 7, now filled, in a simultaneous movement, is displaced from filling station II by the can exchanger into a reject position III as can 71.

The cans 70 are placed in the ready state position I in the customary way, for instance, by being set in a can-track 22 downhill in the direction of the draw frame 2. In a similar manner, the cans 72, 73 . . . which are found in the reject position III (see FIG. 3) are sequentially displaced by the next can 71 brought into this position onto an additional can-track 23, from which the cans 72, 73 . . . likewise, in customary manner, are taken away.

The turntable 8 exhibits a fiber band feed opening 80, through which the fiber band, now drawn by the draw frame, is deposited into can 7 which is being filled. As this is being done, the turntable, in conventional manner, is driven in rotation in the direction of the arrow $f_2$. Simultaneously, the can 7 with the help of a not shown rotating plate is turned in the direction of arrow $f_3$, whereby the result is that the fiber band is deposited in the form of loops in the can 7.

So that the cans 7, 70 follow the circular motions of the can exchanger 5, an arc-shaped can guide 90 is provided, which, in its most simple form, is designed as a semicircle. This configuration is indicated in FIG. 1 by the dotted lines.

On the axle 50 of the can exchanger, is found a non-rotating, band cutting device 21, from which the corresponding cutting element 210 can be pivoted for the cutting of the fiber bands.

In the case of a "flying can exchange", the fiber band feed to the draw frame 2 is not interrupted. Thereby, all the deposition of the fiber band should occur in one can, i.e., 7 (or 70) also without interruption. For this purpose, the turntable 8 is placed as near as possible to the axle 50 of the can exchanger 5, in any case, so near to this axle 50 (axis of rotation $A_2$) that the distance a, between the axis of rotation $A_1$ of the turntable 8 and the axis of rotation $A_2$, is no larger than the distance $a_2$ between the center point M (which is found in the filling station II underneath the can 7 or 70 . . . ) which is located on turntable 8 and the axis of rotation $A_2$.

Figure 1:
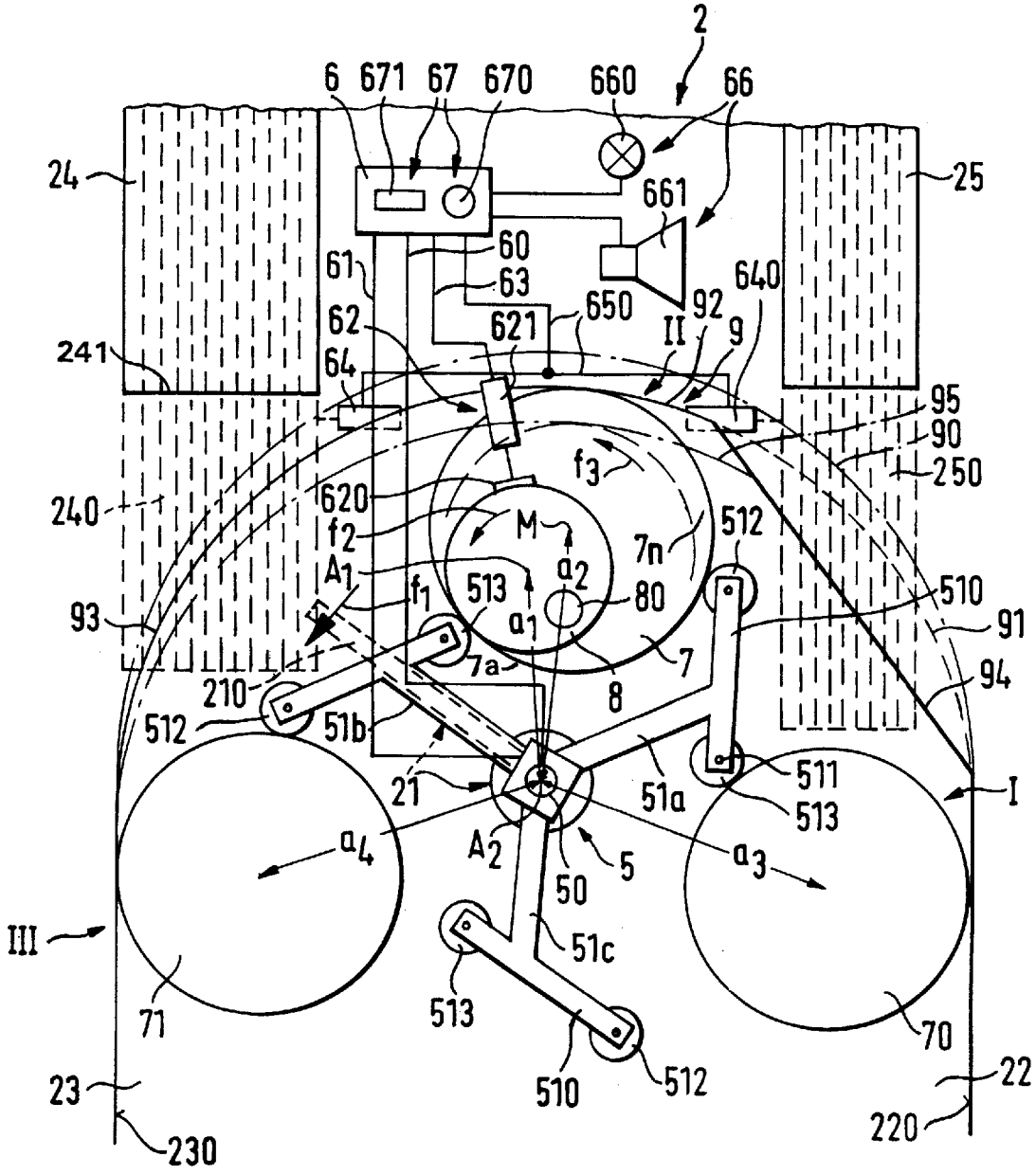
FIG. 1 shows, in schematic top view, the parts of a draw frame relevant to the invention.

For a description of the function of the apparatus already outlined above, as to its construction, reference is first made to the illustration presented in FIG. 1. Each of the three placement positions of the can exchanger 5 is shown as occupied by a can. In the ready-state position I, there is an empty can 70, which, upon the next can exchange, will be brought into the filling position II. The filling position II, however, is now taken up by the can 7, which is secured in its place by the rollers 512 of the arm 51*a* and the rollers 513 of arm 51*b*. In this filling station II, the can 7 possesses a position on the previously mentioned can-plate (not shown) by which it is continually rotated. Above the can 7, the turntable 8 (or another equivalent element) rotates and lays the fiber band in the can 7 in the form of loops until the can is filled. The point of time when the can is filled is determined in a conventional way (and therefore not described in detail), through the measurement of the band length discharged into the can 7 or by a proximity activated sensor of the contents of the can.

For the execution of the can exchange, the control center 6 sends a corresponding command through the line 60 to the drive 52 of the can exchanger 5. This device is thus set into rotation in the direction of the arrow $f_1$. When this occurs, the can 7, by means of the rollers 512 on the arms 51*a*, is pushed out of the filling station II in the direction of the reject position III, in which, again, another already filled can 71 is standing. By the impact of the full can 7 against the can 71, the latter is ejected by the rollers 512 of the arm 51*b* onto the can-track 23, where it either collides with another can 72 (see FIG. 3) which sequentially displaces yet another can 73 along the can-track, or, by means of a customary downward slope of the can-track 23, the reject position III is automatically released by gravitational means.

During the can exchange, the rollers 512 on the arm 51*c* run into the can 70, which is in the ready state position I, and transport this can 70 by means of the rotation of the can exchanger 5 to the filling station II. At the same time, the cans 74 and 75 . . . move on the can-track 22 by conventional means further towards the draw frame 2, whereby, the next available can 74 reaches the ready state position I of the can exchanger 5.

While the filled can 7 is being moved out of the filling position II into the reject position III, the drawn fiber band uninterruptedly issues from the band feed opening 80 of the turntable 8 (or another appropriate feeding element). Thus it is important, that the time interval, during which no can is to be found in the operational area of the turntable 8, must be held to an absolute minimum. This will be achieved with the described equipment by the placement of the turntable 8 in the closest possible location to the axis of rotation $A_2$of the can exchanger 5. As may be seen in FIG. 1, the spatial interval is less, measured along the curve, between the turntable 8 and the can 70, which is to be moved to the filling station II, when the turntable 8 is placed in its position as close as possible to the axis of rotation $A_2$of the can exchanger 5, than when, as is conventional, the turntable is placed on that half of the can exchanger 5 remote from the axis of rotation $A_2$. This leads to the situation wherein the fiber band, which is to be deposited, is very quickly deposited in the newly brought in empty can 70 after the filled can 7 has been displaced from underneath the turntable 8.

After the rollers 512 of the arm 51*b* of the can exchanger 5 pass the operational range of the cutting element 210 of the band cutter apparatus 21, and before the rollers 513 of this arm have reached the operational range, the band cutting apparatus 21 is activated through the line 61 from the control apparatus and thereupon cuts through the fiber band which is now being delivered from the turntable.

Due to the described placement method of the turntable 8, the fiber band, which continues to be discharged, is now to be deposited into the newly installed empty can 70. By means of its weight, this band end, caused by the just described cutting, drops into the empty can 70.

The other end, arising from the cutting of the fiber band, is relatively short and hangs down somewhat outside of the now filled can 7 which has been brought into the reject position II. This eases, in further operations, the finding of the beginning of the band end for the installation of a running out band end into a band working textile machine. Thus, the protruding band end is regarded as desirable.

From the above description, it becomes evident that through the now explained placement of the turntable 8 on the half of the can exchanger 5 proximal to the axis of rotation $A_2$ of the can exchanger 5, the length of the unbroken, continually emerging fiber band, which is not deposited directly into the can 7 leaving the filling station II or into the newly brought in can 70 into the filling station II, is very short and thus can be tolerated as presenting no danger of an upset condition.

Both the described process as well as the described apparatus allow themselves to be altered or enhanced in a multitude of ways without leaving the framework of the invention. Thus, the described features can be replaced by equivalents, or be employed in different combinations. It is also possible that the presuppositions for a "flying can exchange " can be optimized, as will be shown in the following. Such an optimization can be achieved by the speed of the can exchanger 5 temporarily increasing during that operational period when the full can 7 leaves the area of the turntable 8 and the next to-be-filled can 70 has not yet entered the operational area of the turntable 8.

It is advantageous not to have to accelerate the can exchanger 5 in a sudden manner, which, in consideration of the case of a full can 7, requires a high application of force.

To avoid this, in accord with FIG. 1, the turntable 8, relative to the can 7 found in the filling station II, is not located on that line between the axis of rotation $A_2$of the can exchanger 5 and the center point M of the can 7 (see the line designating the distance between the points, $a_2$), but contrarily, is located relative to the moving direction of the leading side of can 7, i.e., edge area 7*a*, during the time of the can exchange. As soon as the can exchanger 5 begins its can exchange movement, then a certain time passes until the can 7 with its trailing can edge or can-edge-zone 7*n* comes into the operational zone of the turntable 8. Up to this moment, the can exchanger 5 can be driven at a desired rate of relatively little acceleration. In spite of this, the exchanger reaches its full rotational speed at the ending of the deposition of the fiber band into the now full, can 7, which is in the process of leaving its place at filling position II.

This allows the can exchanger 5, to be driven at an advantageously high rotational speed without excessive consumption of power during the transition from band deposition into the full can 7 to deposition into the empty can 70, which is now entering the filling station II.

Subsequently, the can exchanger 5 can be relatively quickly braked, since, for this braking effort, little reactive force is encountered.

For reasons contained in the construction of the equipment, it is often not possible to place the can-tracks 22 and 23 so close to each other, even though this construction might be most favorable for the above example. If the can-tracks 22 and 23 are at a larger distance from one another than the close spacing shown in FIG. 1, then the can-tracks 22, 23 would be simply bound to one another by a semicircular can guide 90, whereby the separating distance between the sequential cans 7 and 70 remains constant. The action of the can exchange, on the other hand, facilitates the temporary reduction of, the separation distance between the can 7 leaving filling position II and the can 70 approaching the filling position.

The mentioned reduction in spacing between the consecutive cans 7 and 70 during the can exchange can be performed by the can guide 9 possessing a non-uniform curvature path. Thus, in accordance with FIG. 1, making reference to the transport direction (arrow $f_1$), a preliminary arc shaped section guide 91 is provided, which extends from the outer edge 220 of the can track 22 to an intermediate section 92 with a lesser degree of curvature. This latter intermediate section 92 assumes a curve about the axis of rotation of the can exchanger 5 which is essentially concentric to the filling station II. This curve continues in a further arc shaped section 93 to end as an extension of the outer side 230 of the can-track 23.

The intermediate section 92 with the reduced radius of curvature is placed nearer the axis of rotation $A_2$ of the can exchanger 5 than is the outer edge 220 and/or 230 of the can-track 22 and/or 23.

In the case of the described embodiment and referring to FIG. 1, this is made more plain by a comparison of certain distances (cans are measured from the center point):

- there is a distance $a_3$ between a can 70 in the ready position I and the axis of rotation $A_2$ of the can exchanger 5;
- there is a distance $a_4$ between a can 71 in the reject position III and the axis of rotation $A_2$ of the can exchanger 5;
- either of the above distances are greater than the distance $a_2$ which represents the distance between a can 7 in the filling station II and the axis of rotation $A_2$ of the can exchanger 5.

By means of the described design of the can guide 9, the goal achieved is that the can 70 approaching the filling station II with the help of the first section 91 of the can guide 9 is turned inwardly in relation to the axis of rotation $A_2$ of the can exchanger 5. Thus, the closer the distance between two sequentially following cans 7 and 70 becomes; the nearer the cans 7, 70 find themselves to the axis of rotation $A_2$ of the can exchanger 5. In like manner, in the described design of the can guide 9, the distance between the can 7, which is leaving the filling station II and the can 70 which is approaching the filling station II is also reduced. In order to achieve this goal, the intermediate section 92 is constructed to be correspondingly long, in order to retain the can 7 leaving the filling station II as long as necessary in the neighborhood of the axis of rotation $A_2$. The section 93, which is the transition zone to the outer edge 230 of the can-track 23, first starts, essentially, after the can 7 has left the zone under the turntable 8, so that the can 7 is then able to increase the distance to the following can 70.

It is also possible to design the section 93 circumferentially around the axis of rotation $A_2$of the can exchanger 5, thus placing the outer edge 220 of the can-track 22 correspondingly at a distance farther out from the axis of rotation $A_2$ of the can exchanger. During this movement, the can 70 approaching the filling station II is thus, substantially diverted in the direction of the axis of rotation $A_2$ of the can exchanger 5 in comparison to a symmetrical design of the can-guide 9.

By means of the temporary reduction of the distance between the two cans 7 and 70, there is corresponding reduction in the time from the leaving of the turntable 8 by the full can 7 and the reaching of the turntable 8 by the empty, to-be-filled, can 70.

In the following, the process described will be explained in even more detail in connection with an additional and more advantageous variant, which is presented in FIG. 1 with dotted lines. In the case of this embodiment, as compared to the last described design of the can guide 9, the curved section 91, between the can-track 22 at the ready state position I on one side and the transition section 92 at the filling station II on the other, is replaced by a straight line section 94. This straight line section has the result of causing the can 70, after leaving the ready state position I, to very quickly accelerate by means of the linear transport path. The can 70 approaches the can 7 leaving the filling station II, so that, after can 7 leaves the turntable 8, can 70 very quickly takes its place in the operational zone of the turntable 8.

For this purpose, the operation of the can exchanger 5, which is only intermittently driven for the period of a can exchange, so follows the direction of rotation of the turntable 8, that the drawn fiber band is essentially deposited in the full can 7 for such a period, until the can leaves the filling station II. The can exchanger 5 is, moreover, so synchronized in the direction of rotation with the turntable 8, that the band delivery opening 80 arrives at the side of the turntable 8 proximal to the following can 70 at that moment when the empty can 70, which is being guided to the filling station II, comes partially inside the area of operation of the turntable 8. This synchronization allows the band deposition to be made into the empty can 70, which is newly brought into the filling station II.

This described process will be explained in more detail by reference to FIGS. 2*a* to 2*c*. These figures indicate the relationships among the cans 7 and 70 as well as the turntable 8 during these essential operational phases. While the can 7 is being filled, it is in filling position II and is, in that place, set into rotary motion by the already mentioned (not shown) can plate in a conventional way (FIG. 1).

This rotation permits the loops of fiber band from the turntable to be equally distributed.

The empty can 70 waits still in the ready state position I.

When the can 7 becomes full, then the can exchanger 5 begins to rotate about its axle 50 (see arrow $f_1$). The full can starts its motion very slowly at first moving out from beneath the turntable 8, whereby the deposition in regard to the can 7 changes from the leading can area 7*v* to the trailing can area 7*n* (see FIG. 2*a*). The rotation of the turntable 8 is so correlated with the movement of the can 7 leaving the filling station II, that the band feed opening 80 locates itself in trailing can area 7*n* of can 7. The band deposition in this can 7 continues, as long as the can 7 remains even partially under the turntable 8. As the full can gradually leaves the full position II and thus also the operational area of the turntable 8, then the empty can 70 approaches the filling station II. At this point of operation, because the construction of the section 91 (or 94) of the can guide 9 leads to a shortening of the can path between the ready-state position I and the filling position II, a reduction of the distance between the cans 7 and 70 is brought about.

Figure 2A:
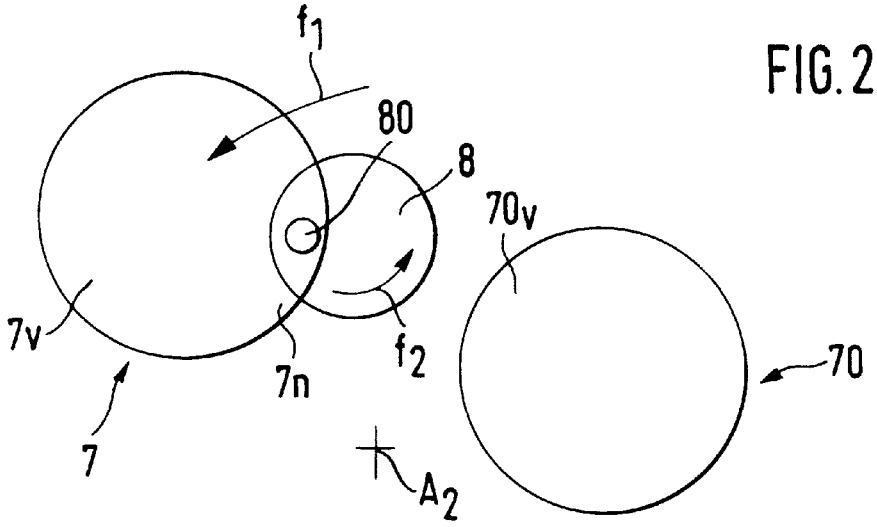
FIGS. 2*a*) to 2*c*) show, in a schematic presentation, various relative positions of the full can as it leaves the filling station and the empty can as it approaches the filling station all relative to the turntable.
Figure 2B:
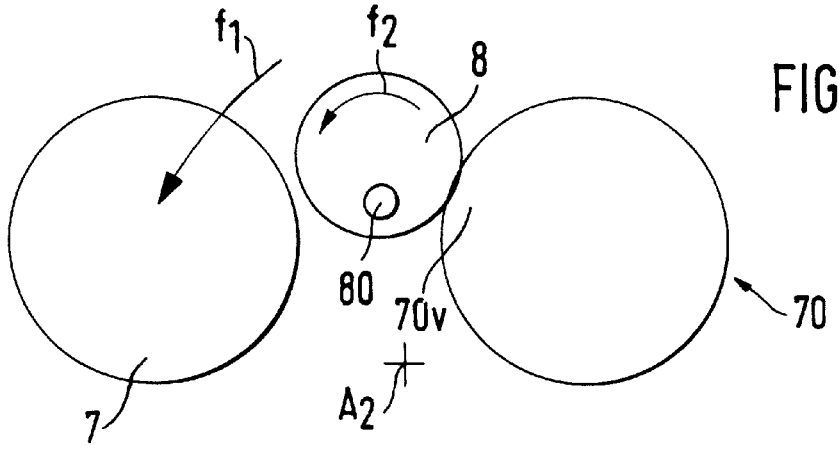

FIG. 2*b* shows a transition phase, in which neither of the two cans 7 and 70 are beneath the turntable 8.

Figure 2C:
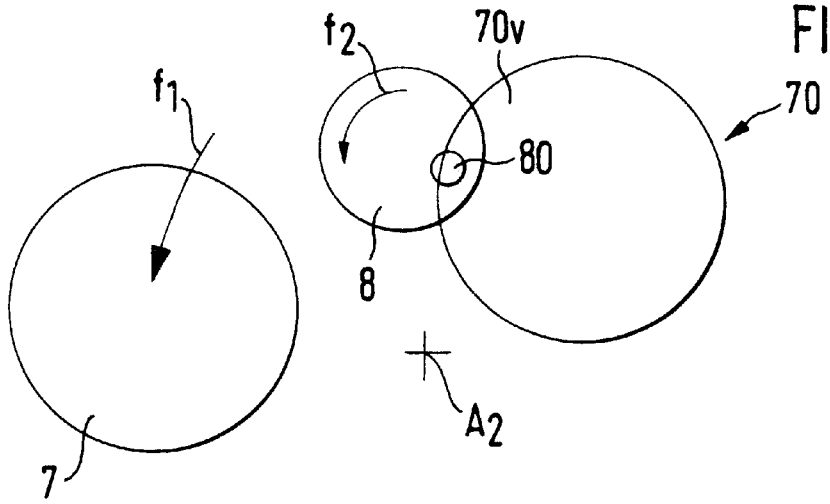

In the operational phase shown in FIG. 2*c*, the can 70 has reached the turntable 8. The rotation of the turntable is so correlated with the advancing movement of the empty can 70, that its fiber band feed opening 80 (with consideration given to its direction of rotation—see arrow $f_2$) reaches the leading can area 70*v* at that moment, when the empty can 70 with its leading can zone 70*v* reaches the turntable. The arrival of the can 70 is accomplished with such speed, that the fiber band feed opening 80 does not again leave the depositing area of the can 70.

In the FIGS. 2*a* to 2*c*, one does not see whether or not the turntable 8, during the transition from deposition from the can 7 to the can 70, carries out essentially a half or more of one revolution, since this detail, for the depicted principle is not necessary.

From the above description, the fact becomes clear, that it is important that the band deposition is carried out as long as possible in the full can 7 and is then taken up as quickly as possible in the empty can 70. In order to control this properly, in accord with the embodiment shown in FIG. 1, a limit switch 62 is assigned to the turntable 8, which essentially can be of any optional design. In the depicted example, the turntable possesses for this purpose on it outer circumference, a reflector 620, which works together with a stationary element 621, which possesses a source of light (not shown) as well as a photo-diode (not shown). This stationary element 621 is connected by a line 63 to the control center 6.

During the filling operation, the limit switch 62 does not function. If, however, in the usual way, a can exchange is initiated, then the limit switch 62 is activated. When the reflector 620 passes the stationary element 621, then the control center 6 receives a signal over the line 63.

The drive of the turntable 8 and the can exchanger 5 as well as the relative placement of the turntable 8 and the cans 7, 70 to be moved by the can exchanger 5 have been explained by the above description. The control center 6 now computes the correct moment for the start of the rotary motion of the can exchanger. The control center does this on the basis of the following data:

- the rotational speed of the turn table 8;
- the programmed speed of the can exchanger 5; and
- the presence of the cans 7, 70 to be moved by the can exchanger 5.

Thus, the stated relationships in accord with FIG. 2*a* to 2*c*, can be held.

For the longest possible period of band depositing in the can 7 leaving the filling station II and for the earliest possible starting of band depositing in the empty can 70 coming into the filling station II, it is advantageous if the direction of rotation (arrow $f_2$) of the turntable coincides with the rotational direction of the can exchanger 5.

However, under certain circumstances, for instance, of a geometric or kinematic nature, even a direction of rotation opposite to that indicated by direction arrow $f_1$ can be of advantage.

If cans of a smaller diameter than have been considered up to now are employed (see can 7*a* indicated by a dotted line), then, by adjustment to the guide means 9, a refitting to accept the deviating can size is achievable. How this refitting is done is indicated with the help of a guide section 95 in FIG. 1 presented in dotted lines. Beyond this, a program corresponding to the new size requirements can be activated in the central control 6.

As a result of the can guide 9, 90 . . . , which reaches relatively far into the structure of the draw frame 2, the area of the draft zone 20 (see FIG. 3), which is to be found above the turntable 8, is located in that area of the draw frame 2 in which the can guide 9, 90 . . . laterally extends beyond the framing of the draw frame 2. A provided platform 24, which normally runs lengthwise along the draw frame 2, reaches principally to the outside of the can guide 9, 90 . . . . This platform 24 is shown with solid lines in FIG. 1.

In order to ease the accessibility to the draft zone 20, (and to other eventually provided elements of the draw frame 2), in accord with the presentation shown in FIG. 1, a swing-away partial platform 240 is provided, which, during the filling procedure, impingingly extends into the can exchanger 5. This extension, however, is essentially into such an area as is not needed by can 7, by one of the neighboring cans 70 and 71, nor by any part of the can exchanger 5 during the filling of can 7. So that the can exchanger 5 is able to function during can exchange, the partial platform 240 is pivotably affixed to the said platform 24. The partial platform 240 can be swung about a hinge 241 (FIG. 3) provided on the platform connection line and laid back on the stationary platform 24 thus allowing freedom of action for the can exchanger 5. obviously, other solutions for the removal of the partial platform 240 are possible to allow freedom of motion for the can exchanger 5, for instance, by means of movement along a set of guides to a secured place at least during the waiting period, which is the state shown in FIG. 1 by dotted lines.

The can guidance 9, 90 . . . is placed so high above the movable partial platform 240, the motion of the partial platform into a position for maintenance or back into the exchanger release position does not cause interference.

In order to avoid function failure due to non-timely release of the can exchanger 5, in accord with FIG. 1, a monitoring safety device 64 is provided for the partial platform 240 which can be designed, in principle, similarly to the limit switch 62. This monitoring device 64 is in connection with the control center 6 by line 650.

As a first measure for the execution of a can exchange, by means of the control center 6, the monitoring device 64 is activated, which determines in which position the partial platform 240 finds itself. If this partial platform 240 is extended into the can exchanger 5, then the can exchange is blocked and the draw frame 2 brought to a standstill.

As was mentioned at the beginning, such a stopping of the draw frame 2 is particularly not desirable when the draw frame 2 is a component of a series of machines including a band issuing textile machine 1, which continually feeds the draw frame with one or more fiber bands 4 . . . , since these other machines must be shut down as well.

Such a shutdown of a band issuing machine such as a carding machine is quite problematic due to the reasons given above. Shutting such a machine down involves a substantial loss in time, although the delay might be tolerable in a combing machine under some circumstances. From these grounds, the shutting down of the draw frame 2 is, as a rule, seen as the last measure of safety precautions. In order to be able (as much as possible) to avoid just such a shutdown of the draw frame 2, in accord with the embodiment presentation in FIG. 1, an alarm system 66 is connected with the control center 6. The alarm system 66 is comprised of a connected signal emitter such as a warning light 660 or a device for issuing a sound signal (for instance a siren 661 or the like).

In principle, a reliable warning ahead of time suffices. In order to adapt the pre-warning, however, to the respective operating conditions or to personal requirements, the control center 6 possesses a time adjustment 67, as is shown in FIG. 1. This time adjustment being comprised of, for instance, an adjustment knob 670 and a display 671 for a repetition of the set time.

This arrangement permits the alarm devices to activate within a chosen specified time period before a can exchange is executed. The adjustable time is the pre-warning time period of the activation of the alarm device 66 up to the foreseen beginning of the can exchange. For instance, if the time adjustment device is set to a time span of 30 seconds, this means that the operating person, who is occupied with the maintenance or the supervision of the draw frame, has thirty seconds of time available to dismount from the partial platform 240 and to move the partial platform out of the operational area of the can exchanger 5. Naturally, other time periods are selectable. With the aid of a correctly chosen pre-warning time, the work on the draw frame 2 must be so planned, that the band deposition can proceed without interruption, since thereby the can exchange can be performed at the right time without hindrance.

Optionally, it is also possible that a platform 25 on the other longitudinal side of the draw frame 2 can be provided with a fold-away partial platform 250, possibly instead of the platform 24 and its partial platform 240 or in addition thereto. Also, quite like the case of the partial platform 240 on the other machine side, the partial platform 250 is assigned a monitoring device 640 which is connected over a line 650 with the control center 6. The function is the same as previously described for the monitoring device 64.

A carding machine has been assumed as a band supplying textile machine 1. This is only a possibility of a band issuing textile machine 1. Another example of a band issuing textile machine 1 is, as already indicated, a combing machine. Contrary to a carding machine, a combing machine delivers fiber bands, the thickness of which, as a rule, already correspond to that thickness that a fiber band leaving a draw frame 2 should exhibit.

In this case, as many fiber bands would be sent from the combing machine to the draw frame 2, as correspond to the otherwise conventional doubling of the draw frame 2 (normally 6 to 8 fold).

If, however, a draw frame 2, which runs in accord with the foregoing description and is designed as particularly advantageous to be operated in common with a carding machine or a combing machine, then the described can exchange itself can be provided, if the band deposition is made in the usual manner with cans.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for drawing at least one continuously fed fiber band and storing the drawn fiber band in a can, the process comprising:

rotating a full can from a filling position underneath a turntable which dispenses the drawn fiber band to a reject position; and simultaneously;

rotating an empty can from a ready-state position into the filling position underneath the turntable without stopping the drawing process; and performing said rotation of the full and empty cans using a rotatable can exchanger that rotates around an axis in such a manner that the empty can from the ready-state position is filled with fiber band from the turntable as the side of the empty can proximal to the can exchanger enters the filling position and the full can continues to receive the fiber band from the turntable as it is rotated by the can exchanger out of the filling position such that the time between ceasing filling of the full can and starting filling of the empty can is minimized; and reducing the time for the empty can in the ready-state position to move into the filling position by moving the empty can in a path other than a constant radius uniform circular path between the ready-state position and the filling position.

2. A process as in claim 1, further comprising rotating the can exchanger in such a manner that the fiber band is deposited in the full can as it leaves the filling position as long as the can remains in the area of the turntable and then deposits the fiber band in the empty can as soon as the empty can reaches the area of the turntable.

3. A process for drawing at least one continuously fed fiber band and storing the drawn fiber band in a can, the process comprising:

rotating a full can from a filling position underneath a turntable which dispenses the drawn fiber band to a reject position; and simultaneously:

rotating an empty can from a ready-state position into the filling position underneath the turntable without stopping the drawing process; and performing said rotation of the full and empty cans using a rotatable can exchanger that rotates around an axis in such a manner that the empty can from the ready-state position is filled with fiber band from the turntable as the side of the empty can proximal to the can exchanger enters the filling position and the full can continues to receive the fiber band from the turntable as it is rotated by the can exchanger out of the filling position such that the time between ceasing filling of the full can and starting filling of the empty can is minimized; and further comprising accelerating gradually the empty can from the ready-state position to the filling position generally from the time the full can leaves the turntable area until the empty can reaches the turntable area.

4. A process as in claim 3, further comprising reducing the spatial interval between the empty can being moved from the ready-state position to the filling position and the full can being moved from the filling position to the reject position during the rotation of the can exchanger.

5. A process as in claim 4, further comprising shortening the path of the empty cans from the ready-state position to the filling position through the use of a can guide system.

6. A process as in claim 5, further comprising shortening the path of the empty cans from the ready-state position to the filling position by using a linear transport path through the use of a can guide system.

7. A process for drawing at least one continuously fed fiber band and storing the drawn fiber band in a can, the process comprising:

rotating a full can from a filling position underneath a rotating turntable which dispenses the drawn fiber band to a reject position; and simultaneously;

rotating an empty can from a ready-state position into the filling position underneath the turntable without stopping the drawing process;

performing the rotation of the full and empty cans using a rotatable can exchanger that rotates around an axis in a manner which brings the empty can from the ready-state position to the filling position;

rotating the can exchanger in such a manner that the fiber band is deposited in the full can as it leaves the filling position as long as the can remains in the area of the turntable and then deposits the fiber band in the empty can as soon as the side of the empty can proximal to the can exchanger reaches the area of the turntable; and gradually accelerating the empty can from the ready-state position to the filling position generally from the time the full can leaves the turntable area until the empty can reaches the turntable area.

8. A process as in claim 7, further comprising reducing the spatial interval between the empty can being moved from the ready-state position to the filling position and the full can being moved from the filling position to the reject position during the rotation of the can exchanger.

9. A process as in claim 7, further comprising shortening the path of the empty cans from the ready-state position to the filling position through the use of a can guide system.

10. A process as in claim 7, further comprising shortening the path of the empty cans from the ready-state position to the filling position by using a linear transport path through the use of a can guide system.

11. An apparatus for drawing at least one continuously fed fiber band and depositing the drawn fiber band in an orderly fashion into round cans, said apparatus comprising:

a turntable having a band feed opening through which the drawn fiber band is distributed into said cans, said turntable being located above a filling position where said cans are placed for depositing the drawn fiber band and having a separate drive connected to an output of said drawing apparatus;

a can exchanger revolvable about a rotatable axle, said can exchanger moving a full can from a filling position to a reject position and simultaneously moving an empty can from a ready-state position to said filling position and having a separate drive to rotate said can exchanger;

a control apparatus for controlling the operation of said can exchanger and said can exchanger drive, said control apparatus configured to control when said can exchanger rotates said full can from said filling position to said reject position and said empty cans from said ready-state position to said filling position; and wherein a distance from an axis of rotation of said can exchanger to an axis of rotation of said turntable is not greater than the distance from a center point of said filling position to the axis of rotation of said can exchanger.

12. An apparatus as in claim 11, wherein said turntable in relation to a can in said filling position is located above a leading portion of said can.

13. An apparatus as in claim 11, further comprising a can guide system integral with said can exchanger, which aids in distributing of the full cans to said reject position and the empty can to said filling position.

14. An apparatus as in claim 13, wherein said can guide system between the ready-state position and the filling position is linear in nature.

15. An apparatus as in claim 11, wherein a spatial interval from a can in one of a ready-state position and said rejection position to the axis of rotation of said can exchanger is greater than a spatial interval of the can in said filling position from the axis of the can exchanger.

16. An apparatus as in claim 11, wherein said turntable and said can exchanger rotate in a common direction.

17. An apparatus as in claim 16, wherein said drives of said turntable and said can exchanger mutually interact allowing said band feed opening of said turntable to follow the full can being conveyed to said reject position from said filling position, until the can and said turntable diverge, at which point in time, said turntable conveys said band feed opening toward the empty can, which converges with said band feed opening simultaneously with said turntable.

18. An apparatus as in claim 11, further comprising a contacting device for monitoring said turntable, said device is connected to said control apparatus.

19. An apparatus as in claim 11, further comprising a platform extending along said drawing apparatus, said platform possessing a movable partial platform that in its operating position extends into the area needed for can exchanging, preventing the operation of said can exchanger and in an idle position of said movable partial platform permits said can exchanger to operate.

20. An apparatus as in claim 19, further comprising a monitoring apparatus for monitoring the position of said movable partial platform, said monitoring apparatus integrally connected to said control apparatus which in turn are connected to an alarm and time adjustment device permitting monitoring of said movable partial platforms for can exchange purposes.

21. An apparatus as in claim 11, wherein the fiber band for said apparatus is fed directly from a delivery end of a band issuing machine to a feed end of said apparatus.

22. An apparatus as in claim 21, wherein said apparatus possesses an entry guide funnel for the fiber band delivered from said band issuing machine.

23. An apparatus as in claim 22, further comprising a band storage facility between the band issuing machine and the apparatus.

* * * * *